US006171135B1

(12) United States Patent
Yang

(10) Patent No.: US 6,171,135 B1
(45) Date of Patent: Jan. 9, 2001

(54) LAMP BASE

(75) Inventor: Wen Ho Yang, Taipei-Hsien (TW)

(73) Assignee: Sun Lite Sockets Industry Inc., Taoyuan Hsien (TW)

( * ) Notice: Under 35 U.S.C. 154(b), the term of this patent shall be extended for 0 days.

(21) Appl. No.: 09/478,082

(22) Filed: Jan. 6, 2000

(51) Int. Cl.[7] ..... H01R 13/58
(52) U.S. Cl. ..... 439/456
(58) Field of Search ..... 439/456, 455, 439/461, 543, 459, 666, 702, 703, 704, 705, 706, 707

(56) References Cited

U.S. PATENT DOCUMENTS 1,794,274 * 2/1931 Blumensaadt et al. ..... 439/455
1,818,614 * 8/1931 Glade, Jr. ..... 439/461
1,829,127 * 10/1931 Cammack ..... 439/455

* cited by examiner

*Primary Examiner*—Brian Sircus
*Assistant Examiner*—Chandrika Prasad
(74) *Attorney, Agent, or Firm*—Bacon & Thomas, PLLC

(57) ABSTRACT

A lamp base includes a base body, a lamp socket fixed under the base body, a housing protecting the base body and the lamp socket, and a cap closing up the housing. To terminals are provided in the base body to connect to two power wires passing through an upper wire hole of the cap. The cap has a short tube portion extending down from the wire hole to press down the power wires on an upper surface of the base body to secure the power wires tightly so as not to loosen off the two terminals if exterior force should pull the power wires by accident.

2 Claims, 11 Drawing Sheets

LAMP BASE

BACKGROUND OF THE INVENTION

This invention relates to a lamp base, particularly to one with a structure of letting connecting power wires not pulled off by external force, not loosening off the terminals, very safe to use and convenient to combine.

A known conventional lamp base shown in FIG. 1, has a lamp base body 10 made of insulating material, a lamp socket 20 with threads for a lamp to engage with, a housing for preventing dirt, and a cap 40 provided with a wire hole 401.

The lamp base 10 has two terminals 101, 102 for connecting two power wires 50 by means of screws or inserting holes. In this example screw connection is shown. The lamp base 10 further has a switch 103 fixed transversely for turning on and off the lamp. And a switch has various structures to handle, such as by turning, pushing or pulling, or with no switches. No matter what structure it may be, its function is the same cap 40 is usually made of metal for good appearance. So an insulating cylinder 301 and am insulating gasket 402 have to be provided respectively to prevent dirt or any bit of miscellaneous matter to enter the lamp base to stick to the two terminals to cause bad contact or unsteady current.

Further, as for the known conventional lamp base and the power wires 50, their connecting mode and the connected condition are shown in FIG. 2. The power wires 50 firstly pass through the wire hole 401 and the gasket 402 of the cap 40, two naked ends connected to the two terminals 101, 102. Generally, a knot 501 is made to the power wires 50 to prevent the same from loosening off or becoming bad contact, for the power wires 50 are connected to the terminals 101, 102. Function of the know conventional structure is to secure the power wires 50 and more securely locating the power wires 50 by sandwiched between the upper surface of the lamp base body 10 and the bottom of the insulating gasket 402. Thus, should the power wires be pulled by exterior force, the knot 501 receives the force, not letting the naked points directly pulled off the terminals 101, 102.

However, the known conventional connecting mode has been found not really avoiding the connect disadvantages mentioned above, but on the contrary involving difficulty in assembly. A first point is inconvenience of assembling in preparing the length of the power wires 50 so as to connect with the terminals 101, 102. A second point is the tightness and the size of the knot 501, impossible to connect with in case of too short, and difficult to close the cap 40 in case of too large, resulting in extreme difficulty in assembling. In addition, in making a knot, a metal wire inside an insulating tube is bent to disfigure, causing bad transmission or unstableness of electric current, if worse. So this kind of knot is not correct usage of electricity.

SUMMARY OF THE INVENTION

The objective of the invention is to offer a lamp base, which has a structure of easy and quick assemblage, and high safety in use.

The feature of the invention is a tube portion of a proper length formed to extend down from a center wire hole of a cap closing on a housing surrounding a lamp base body and a lamp socket fixed under the lamp base body for a lamp to screw in. When the cap closes an upper end of the housing, the tube portion may press two power wires down on an upper surface of the lamp base body to secure the power wires tightly so as not to let their naked ends separated or loosened from two terminals in the lamp base body if exterior force pulls the power wires by accident

BRIEF DESCRIPTION OF DRAWINGS

This invention will be better understood by referring to the accompanying drawings wherein.

DETAILED DESCRIPTION OF THE PREFERRED EMBODIMENT

In order to understand preferred embodiments of the invention, combining modes of power wires and a lamp base are to be described, classified into two kinds.

1. A Screw Securing Mode.

Figure 1:
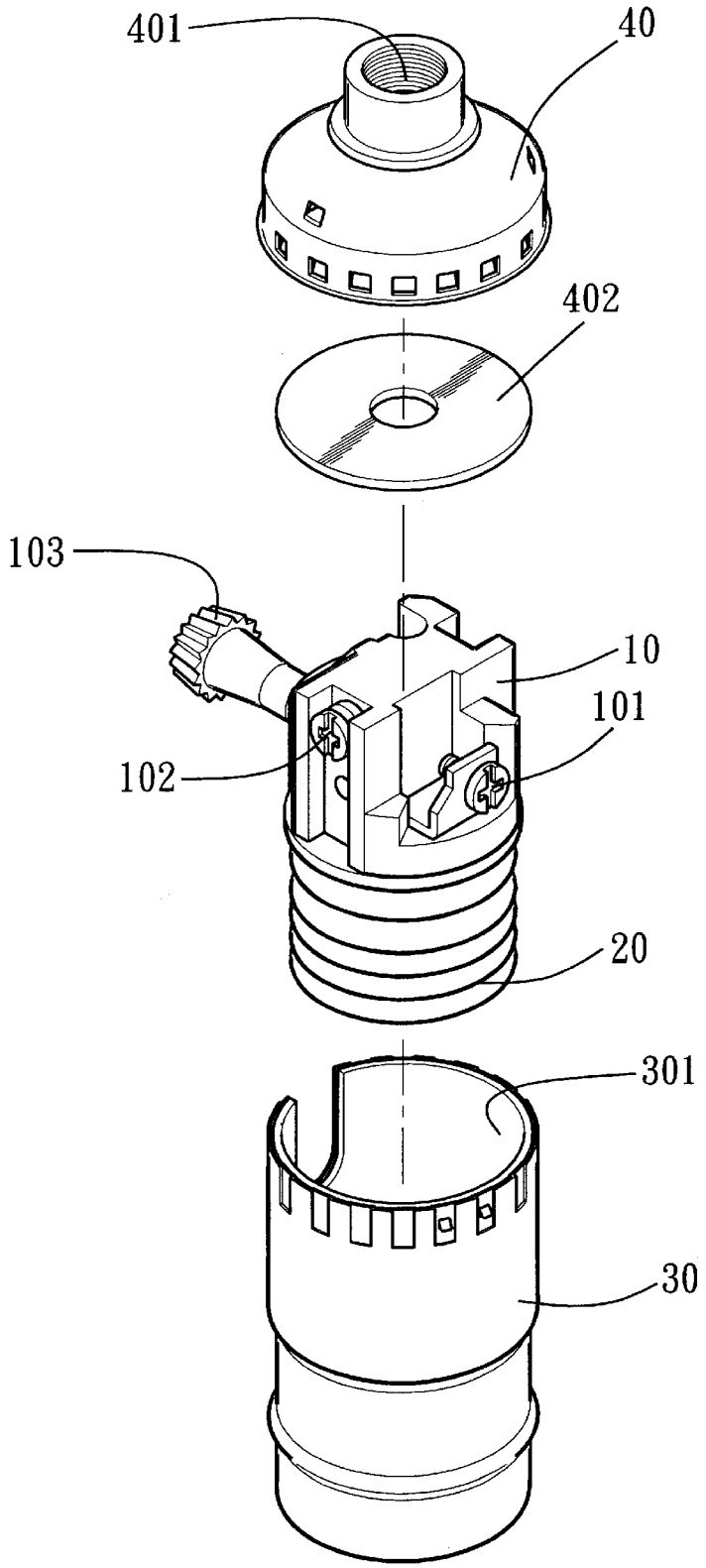
FIG. 1 (PRIOR ART)
FIG. 1 is an exploded perspective view of a known conventional lamp base.
Figure 2:
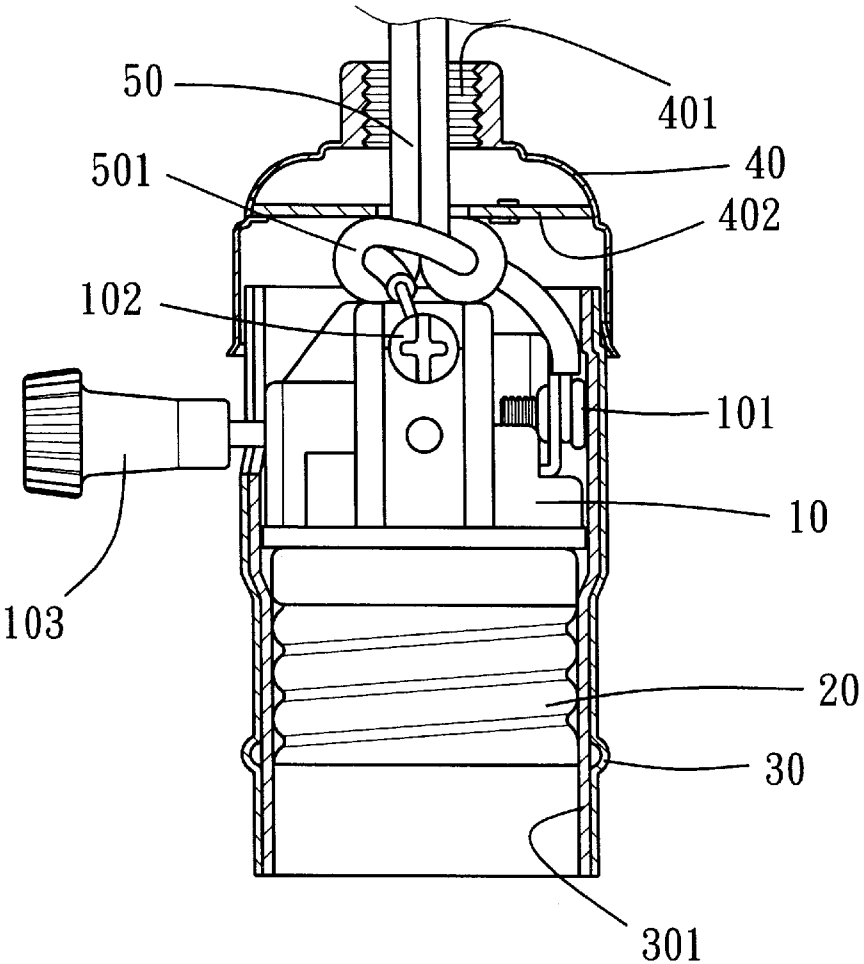
FIG. 2 (PRIOR ART)
FIG. 2 is a cross-sectional view of the known conventional lamp base.
Figure 3:
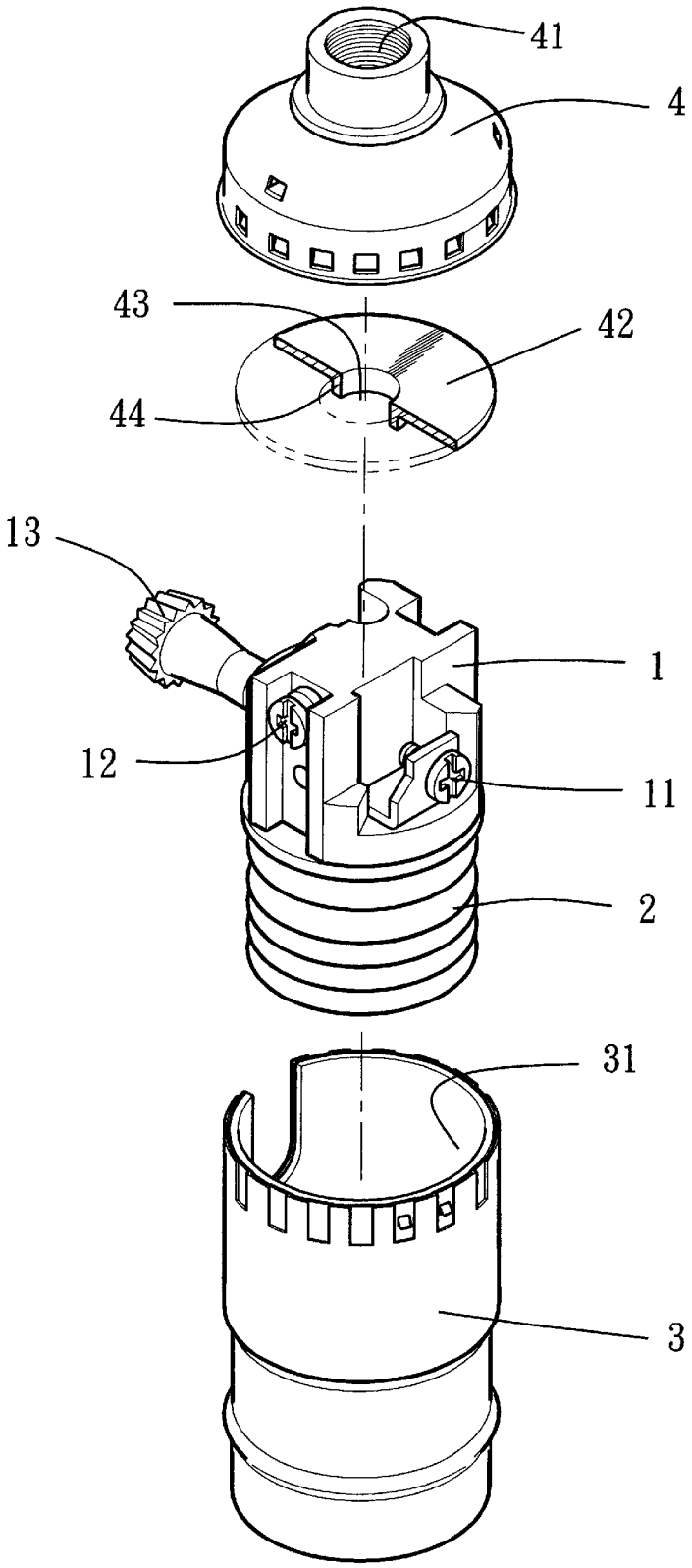
FIG. 3 is an exploded perspective view of a lamp base in the present invention.

As shown in FIG. 3, the invention includes a lamp base body 1 made of an insulating material, a lamp socked 2 fixed under the lamp base 1 for a lamp to screw in, a metal housing 3 surrounding the lamp base body 1 and the lamp socket 2, and a metal cap 4 closing an upper open end of the housing 3.

The lamp base body 1 has two terminals 11, 12 connected to two power wires with screws, and a switch 13 fixed laterally to turn on and off power.

Figure 4:
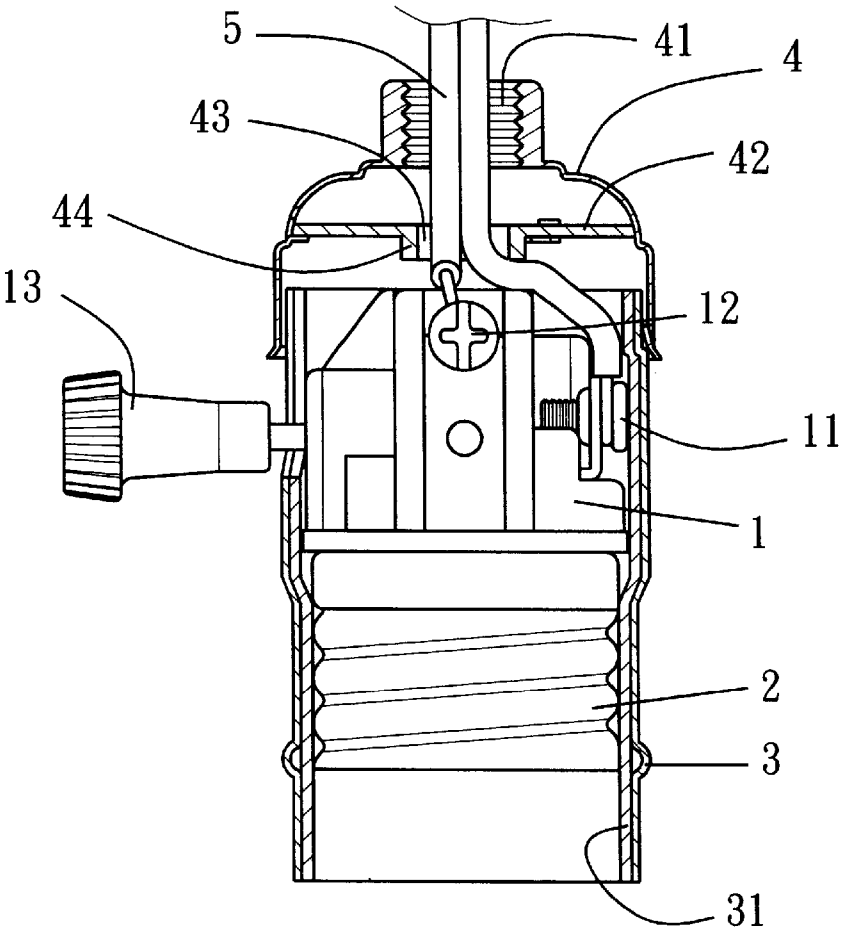
FIG. 4 is a cross-sectional view of the lamp base under using condition in the present invention.

The housing 3 has an insulating cylinder 31 on an inner peripheral surface, and the cap 4 has an insulating gasket 42 with a center wire hole 43 fixed in the cap 4. The main characteristic is a short tube portion 44 extending down from the center hole 43. When the power wires 5 pass through an upper wire hole 41 of the cap 4, the center hole 43 of the gasket and through the short tube portion 44, naked ends 51 of the power wires 5 are connected with the terminals 11, 12 of the lamp base body 1. Then after the cap 4 closes the housing 3 as shown in FIG. 4, the short tube portion 44 presses and forces the power wires 5 on an upper surface of the lamp base body 1 in an L-shaped condition, so that when exterior force pulls the power wires 50 by accident or unintentionally, the exterior force may not reach or affect the naked ends 51 connected to the terminals 11, 12.

Figure 5:
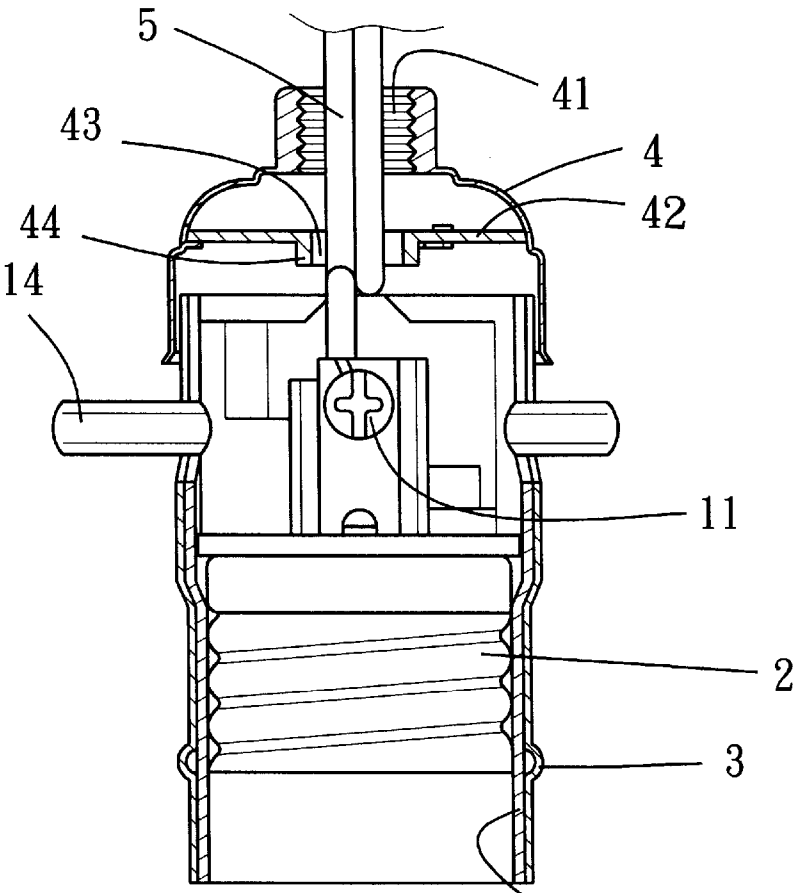
FIG. 5 is a cross-sectional of the first embodiment of a lamp base using a screw mode and with a switch under using condition in the present invention.
Figure 7:
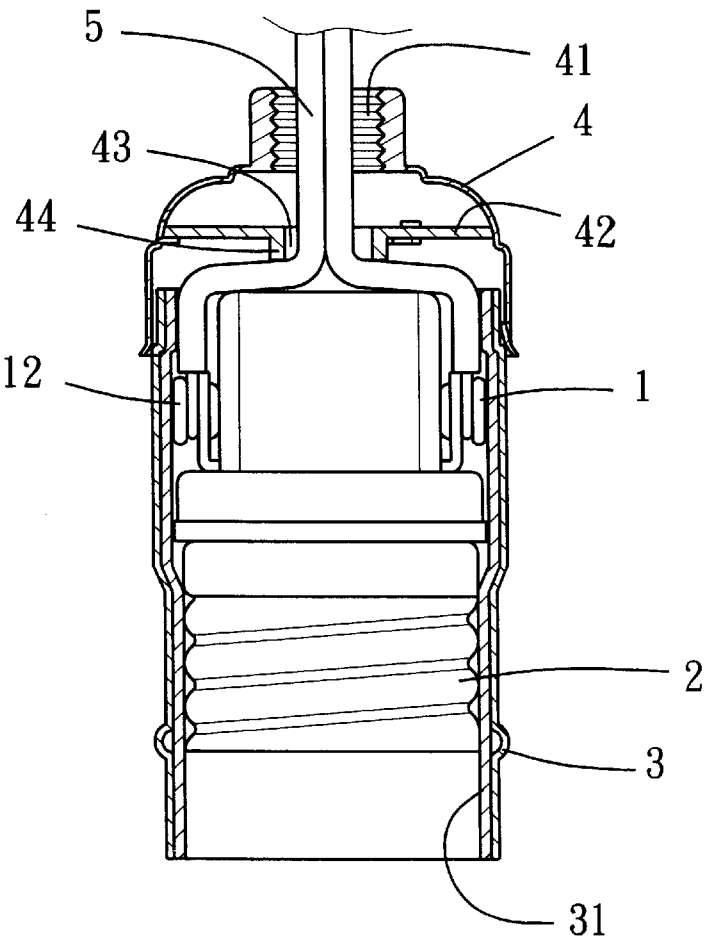
FIG. 7 is a cross-sectional view of the first embodiment of a lamp base using a screw mode and with no switch in the lamp base in the present invention.
Figure 6:
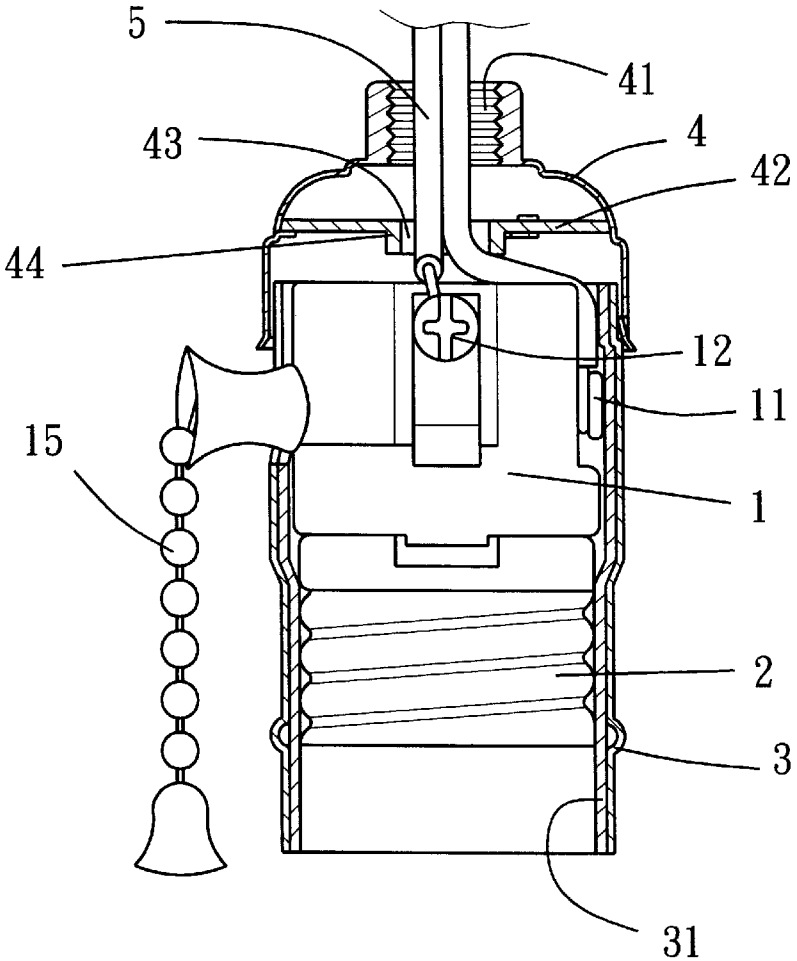
FIG. 6 is a cross-sectional view of the first embodiment of the lamp base using a screw mode and with a pull chain switch in the present invention.
Figure 10:
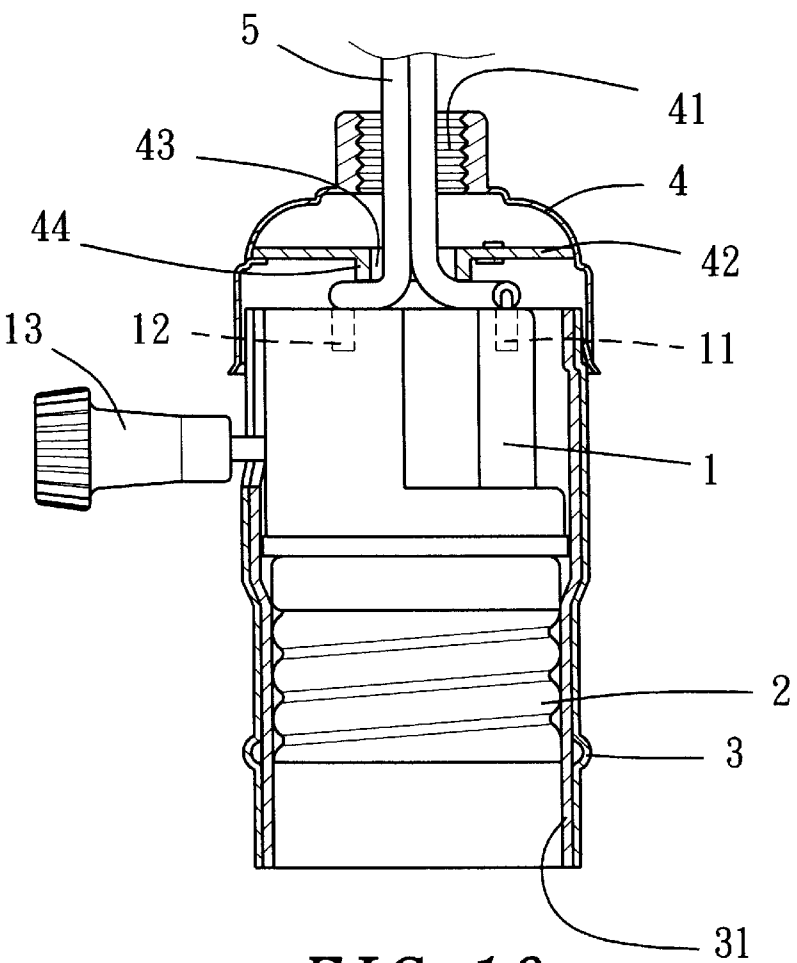
FIG. 10 is a cross-sectional view of FIG. 9 under using condition.

Next, another mode is shown in FIGS. 5 and 6, having the same lamp base body 1, the same lamp socket 2, the same housing 3 and the same cap 4 and the same insulating gasket 42 as the example just described above. The different point is that a push switch 14 shown in FIG. 5 or a pull chain switch 15 shown in FIG. 6 is used. One more mode is no switch is provided in a lamp base body 10 but a push button fixed on a wall is used to turn on and off the lamp on the lamp base, as shown in FIG. 7. Those examples all use the insulating gasket 42 and the short tube portion 44 for securing the power wires 5 on the upper surface of the lamp base body 1.

Figure 8:
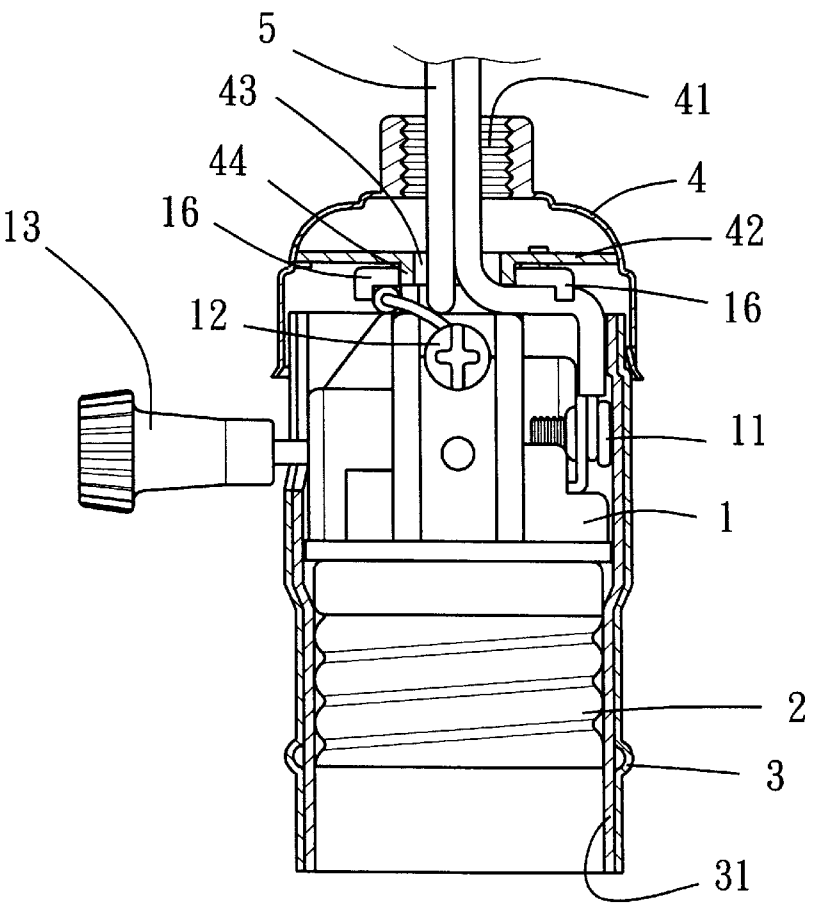
FIG. 8 is a cross-sectional view of the first embodiment of a lamp base using a screw mode with wire fixers in the present invention

Further, this mode can be applied to a lamp base body 1 with wire fixers as shown in FIG. 8, and this lamp base body 1 has two inverted L-shaped wire fixers 16 for the power wires 5 to fit therein, with cooperation of the short tube portion 44 pressing the power wires 5 at the same time to obtain double securing function, using a rotating switch or other switches.

An Insert Clamp Mode.

Figure 9:
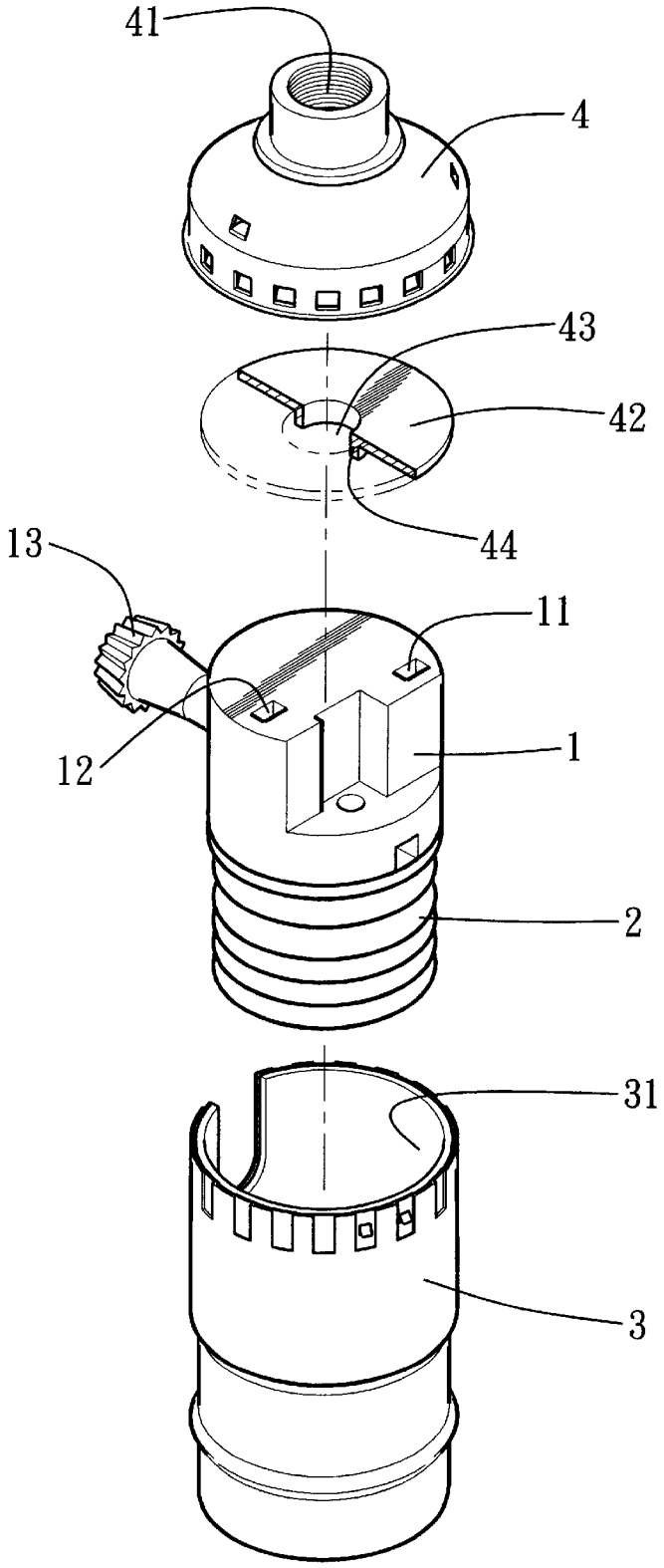
FIG. 9 is an exploded perspective view of the first embodiment of a lamp base with an insert clamp mode and with a rotating switch in the present invention.

As shown in FIG. 9, a lamp base body 1 is used, a lamp socket 2 fixed under the lamp base body for a lamp to screw in, a metal housing 3 and a metal cap 4 with a wire hole 41 are also provided. But the lamp base body 1 has two insert holes 11, 12 in an upper flat surface for two naked ends of power wires to insert and clamped tightly therein. A rotating switch 13 is provided to extend out of the lamp base body, and the housing 3 has an insulating cylinder 31 inside. The cap 3 has an insulating disc 42 with a center hole 43 and a short tube portion 44 extending down from the center hole 43. When the power wires 5 extend through the upper center hole 41 of the cap, the center hole 43 and the short tube portion 44, the two naked ends 51 of the power wires 5 insert in the insert holes 11, 12 of the lamp base body 1. When the cap 4 closes the housing 3, the short tube portion 44 press the power wires 5 on the upper surface of the lamp base body 1 to let the wires bent as L-shaped.

Figure 12:
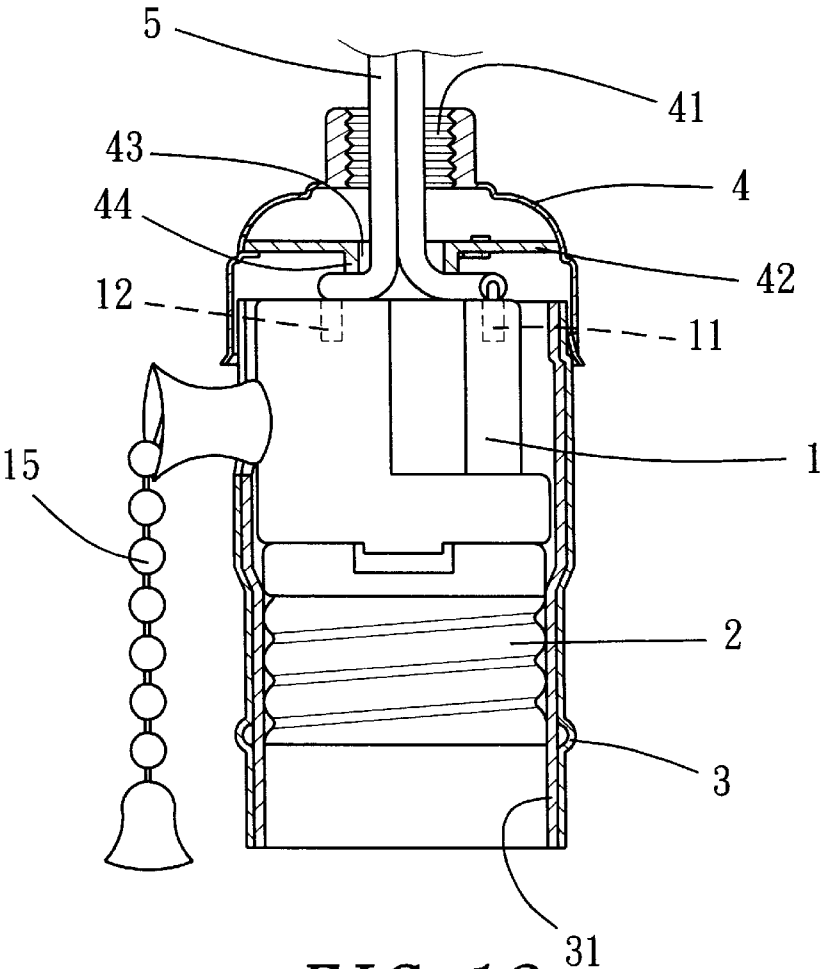
FIG. 12 is a cross-sectional view of the first embodiment of a lamp base using an insert clamp mode with a pull chain switch in the present invention.
Figure 11:
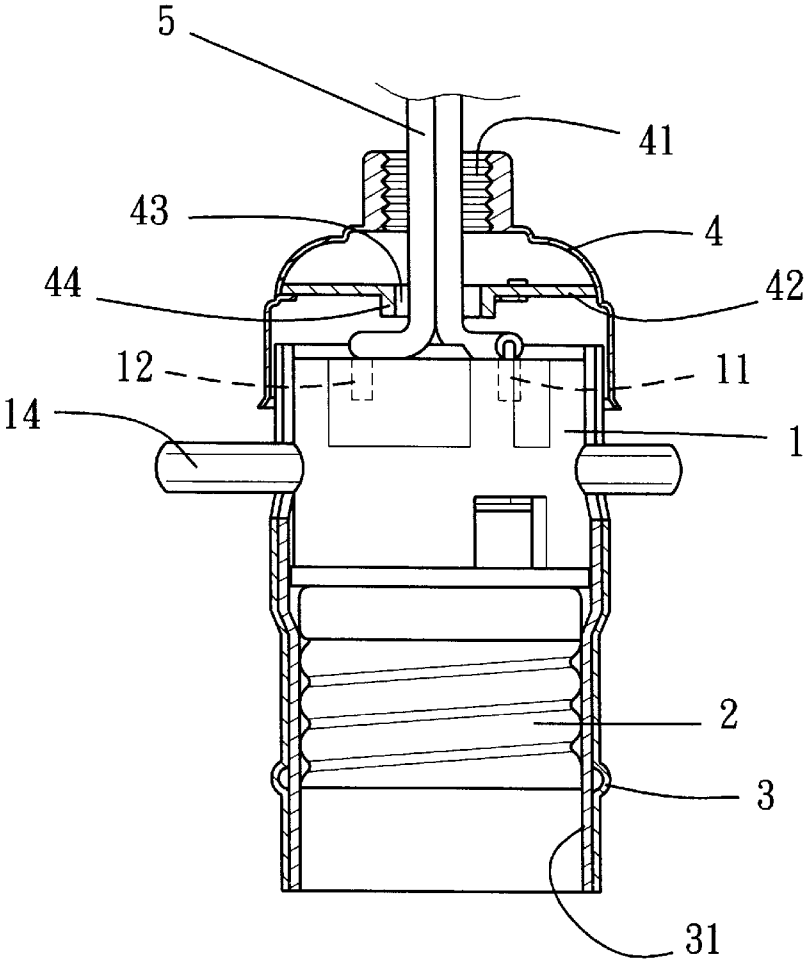
FIG. 11 is a cross-sectional view of the first embodiment of a lamp base using an insert clamp mode with a push switch in the present invention.
Figure 14:
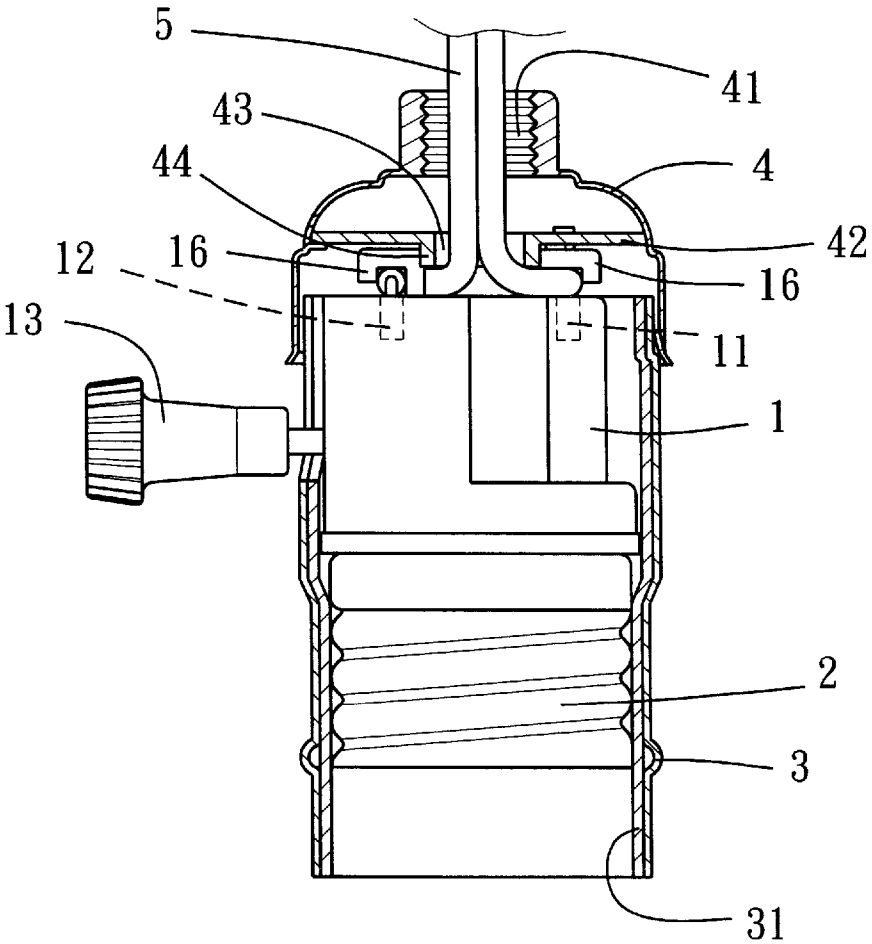
FIG. 14 is a cross-sectional view of the first embodiment of a lamp base using an insert clamp mode and wire fixers in the present invention.
Figure 13:
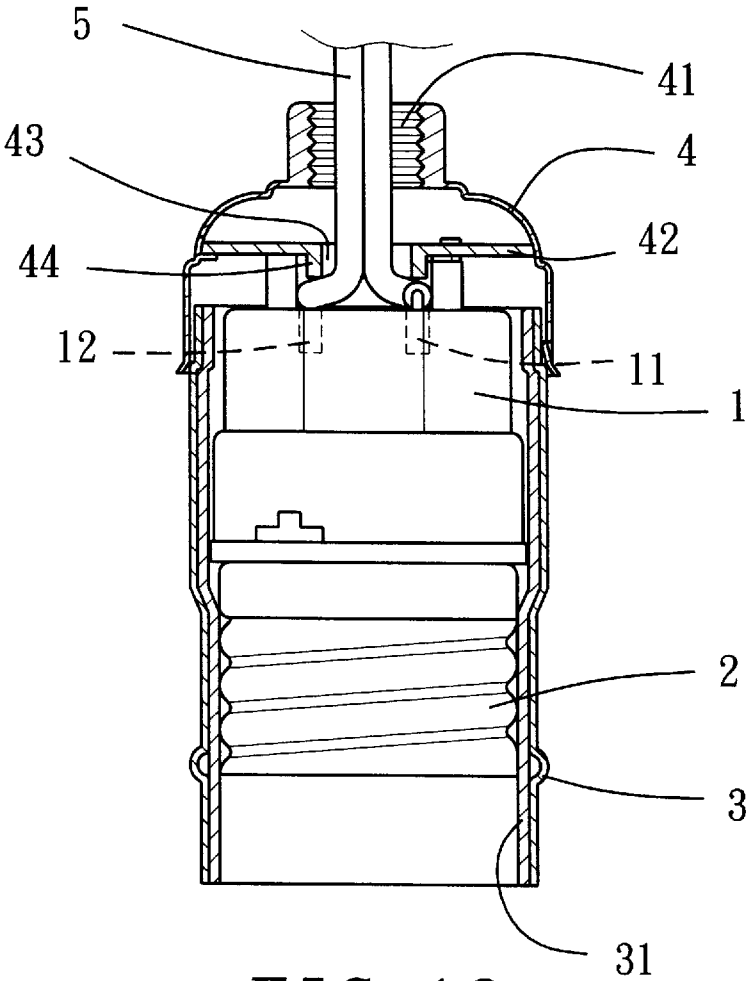
FIG. 13 is a cross-sectional view of the first embodiment of a lamp base using an insert clamp mode with no switch in the present invention.

This insert and clamp mode also has various control methods, as shown in FIGS. 11, 12 and 13, respectively provided with a push switch 14, a pull chain switch 15 or no switch. FIG. 14 shows that a lamp base body 1 has two insert holes 11, 12 in an upper surface, two upright wire fixers 16, and a rotating switch 13 at one side. The difference between the lamp base with the insert holes and that with a screw fastening mode is only the connecting methods of the power wires 5 with the lamp base body 1. They all use the insulating gasket 42, and the short tube portion 44 to secure the power wires 5.

Figure 15:
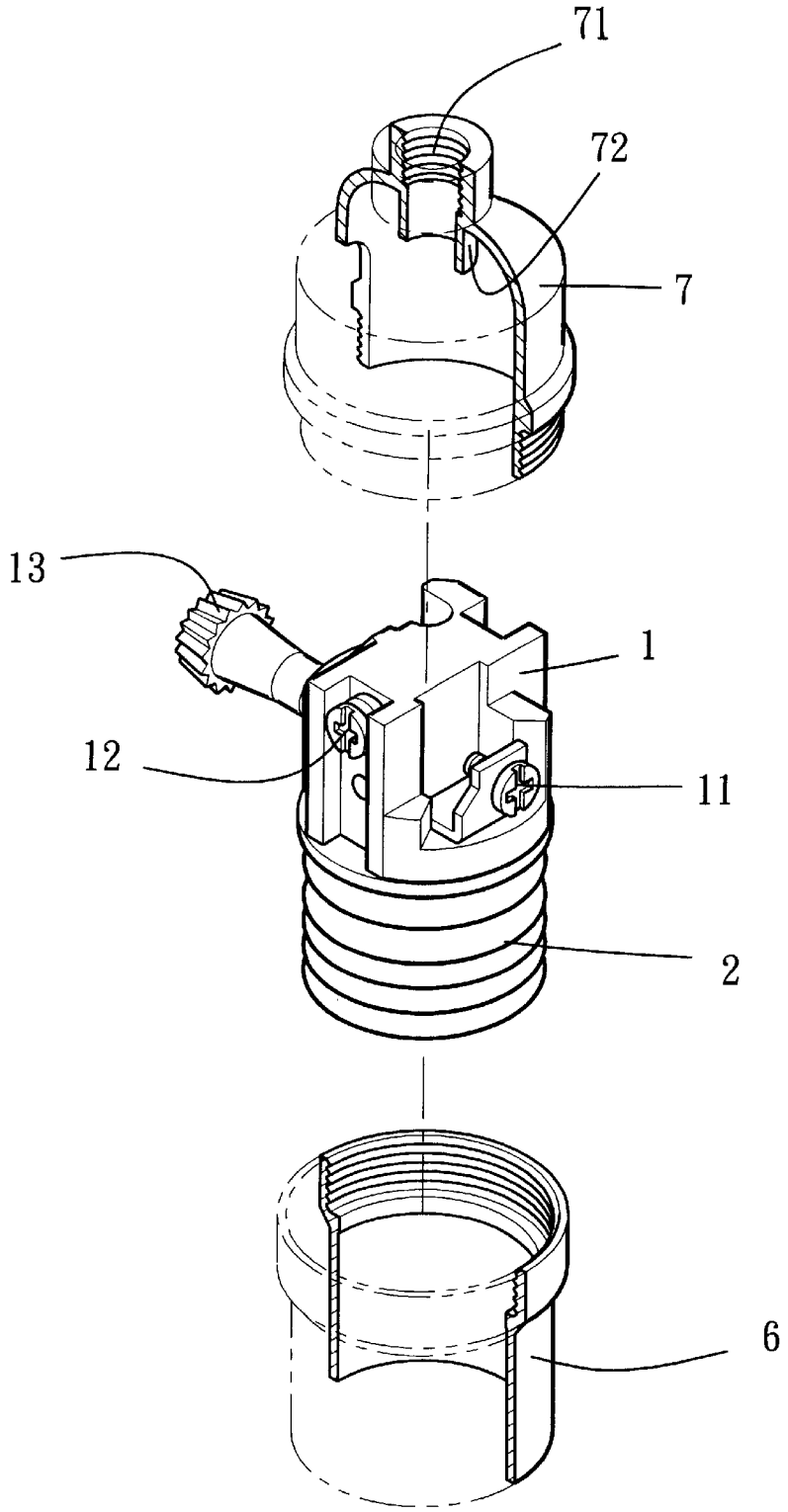
FIG. 15 is an exploded perspective view of a second embodiment of a lamp base using a screw mode with a rotating switch in the present invention.
Figure 16:
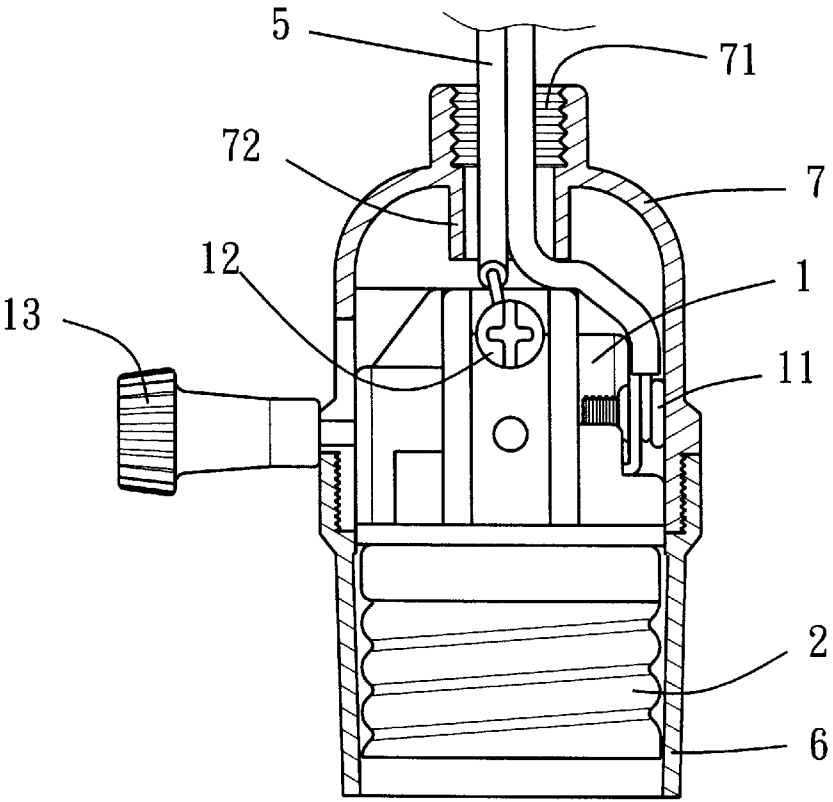
FIG. 16 is a cross-sectional view of FIG. 15 under using condition; and, FIG. 17 is a cross-sectional view of the second embodiment of a lamp base using a screw mode with wire fixers in the present invention.

Next, a second embodiment of a lamp base is shown in FIG. 15, which includes a housing 6 made of an insulating material, a cap 7 also made of an insulating material, a lamp base body 1 made of an insulating material, and a lamp socket fixed under the lamp base body 1 for a lamp to screw with. The lamp base body 1 has two terminals 11, 12 to connect to power wires 5 by means of a screw fastening or inserting fastening. FIG. 15 shows the screw fastening method. And a rotating switch 13 (a push switch, a pull chain switch or no switch) is provided at one side of the lamp base body 1. Further, the cap 7 has an upper wire hole 41 for the power wires 5 to pass through in. The main feature of this embodiment is a tube portion 72 of a proper length formed to extend down from the upper center wire hole 71. Then the power wires 5 pass through the wire holes 71 of the cap 7 and the tube portion 72, and are connected to the terminals 11, 12, After the cap 7 is closed on the housing 6 as shown in FIG. 16, the tube portion 72 may press the power wires 5 down on the upper surface of the lamp base body 1, with the wires 5 bent as an L-shape. Should any exterior force pull the wires 5, it might not let the naked ends 51 of the wires 5 separated or loosened from the terminals 11, 12.

Figure 17:
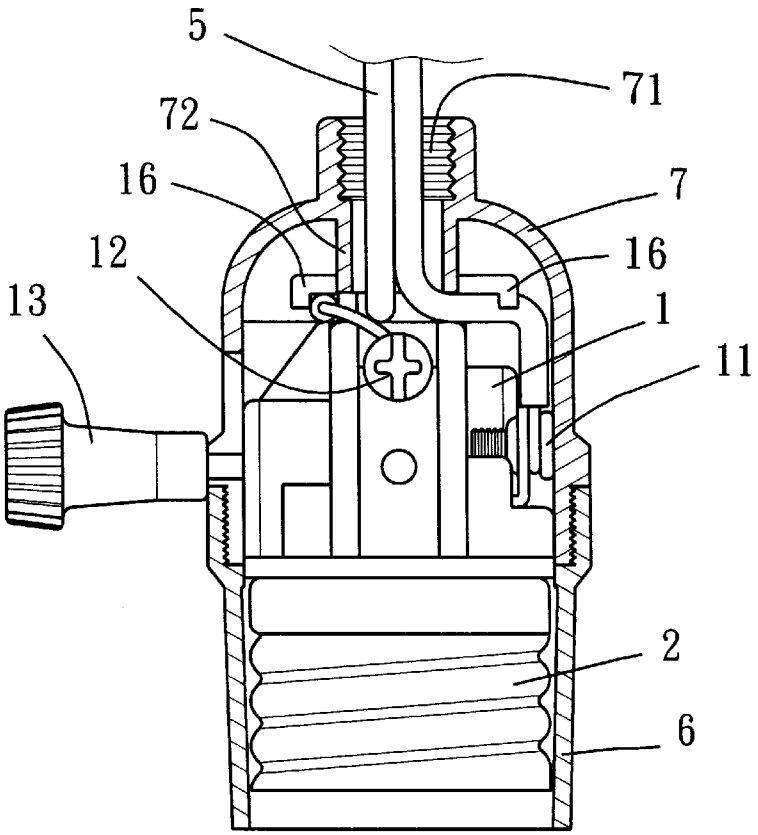

If the wire fixers 16 are provided on the lamp base body 1, the tube portion 72 of the cap 7 may press down the power wires 5 on the lamp base body 1, as sown in FIG. 17, resulting in double positioning effect.

In general, the special feature of the invention is the tube portion formed in the cap closing on the housing, pressing and securing the power wires in position and not easily pulled off the terminals of the lamp base body, no matter what the connect mode of the power wires with the lamp base body may be, or no matter what the switch may be.

I claim:

1. A lamp base comprising a lamp base body made of an insulating material, a lamp socket fixed under said lamp base body for a lamp to screw with, a housing surrounding said lamp base body and said lamp socket, and a cap closing on said housing; said lamp base body having two terminals for two naked ends of power wires to connect to, and a switch fixed with said lamp base body to turn on and off said lamp, said cap having an upper center wire hole for said power wires to pass through in, an insulating gasket with a center hole placed in said cap; characterized by a short tube portion formed to extend down from said center hole of said gasket, said short tube portion pressing down said power wires on an upper surface of said lamp base body to bend as an L-shape so as not to let exterior force pull said naked ends of said power wires completely separated from said terminals after said power wires pass through said upper center hole of said cap and through said center hole and said tube portion of said gasket and have said naked ends connected to said terminals and said cap is closed on said housing.

2. A lamp base comprising a lamp base body made of an insulating material, a lamp socket fixed under said lamp base body for a lamp to screw with, a housing made of an insulating material surrounding said lamp base body and said lamp socket, and a cap made of an insulating material screwing with an upper end of said housing; said lamp base body having two terminals for naked ends of two power wires to connect to, a switch fixed with said lamp base body to turn on and off said lamp, or said switch not fixed with said lamp base body, said cap having an upper center wire hole for said power wires to pass through in; characterized by said cap having a tube portion of a proper length extending down from said center wire hole, said tube portion of said cap pressing said power wires on an upper surface of said lamp base body to bend as an L-shape so as not to let exterior force pull said power wires separated completely from said terminals after said power wires pass through said center wire hole and said tube portion of said cap with naked ends of said power wires connected to said terminal and said cap screws with said housing.

* * * * *